US005445500A

United States Patent [19]

Taguchi

[11] Patent Number: 5,445,500

[45] Date of Patent: Aug. 29, 1995

[54] METHOD OF TRANSFERRING FLUENT MATERIAL WITH COMPRESSED GAS

[75] Inventor: Akira Taguchi, Osaka, Japan

[73] Assignee: Mori-Gumi Co., Ltd., Osaka, Japan; a part interest

[21] Appl. No.: 137,217

[22] Filed: Oct. 18, 1993

Related U.S. Application Data

[63] Continuation of Ser. No. 965,781, Oct. 23, 1992, abandoned.

[30] Foreign Application Priority Data

Oct. 25, 1991 [JP] Japan ..... 3-280118

[51] Int. Cl.[6] ..... F04E 1/06

[52] U.S. Cl. ..... 417/54; 417/137

[58] Field of Search ..... 417/54, 137, 138, 139, 417/140, 141, 142, 143, 144, 145, 146, 147, 148, 149

[56] References Cited

U.S. PATENT DOCUMENTS

| | | | |
|---|---|---|---|
| 2,077,898 | 4/1937 | Rolff . | |
| 3,005,417 | 10/1961 | Swaney | 417/138 |
| 3,082,698 | 3/1963 | Smith | 417/142 |
| 3,328,089 | 2/1966 | Hodgson et al. . | |
| 3,333,901 | 3/1967 | Hodgson et al. . | |
| 3,689,045 | 9/1972 | Coulter et al. . | |
| 3,762,773 | 10/1973 | Schroeder . | |
| 3,829,246 | 8/1974 | Hancock | 417/138 |
| 3,864,060 | 2/1975 | Hall, Jr. et al. | 417/138 |
| 3,883,269 | 5/1975 | Wolff | 417/149 |
| 4,111,492 | 9/1978 | Mraz . | |
| 4,381,897 | 5/1983 | Arbeletche et al. . | |
| 4,408,960 | 10/1983 | Allen | 417/149 |
| 4,507,056 | 3/1985 | Allen | 417/149 |
| 4,524,801 | 6/1985 | Magnasco et al. | 417/148 |
| 4,685,840 | 8/1987 | Wolff . | |
| 4,765,779 | 6/1988 | Organ . | |
| 4,818,187 | 4/1989 | Scampini | 417/143 |
| 4,938,637 | 7/1990 | Lybecker et al. . | |

FOREIGN PATENT DOCUMENTS

| | | | |
|---|---|---|---|
| 3439251A1 | 4/1986 | Germany . | |
| 54-113176 | 9/1979 | Japan . | |
| 137111 | 10/1979 | Japan | 417/138 |
| 55-145929 | 11/1980 | Japan . | |
| 59-172328 | 9/1984 | Japan . | |
| 1421645 | 9/1985 | U.S.S.R. . | |
| 1207942 | 11/1986 | U.S.S.R. . | |
| 1402518 | 6/1988 | U.S.S.R. . | |
| 1418215 | 8/1988 | U.S.S.R. . | |
| 1525339 | 11/1989 | U.S.S.R. | 417/138 |
| WO87/05586 | 9/1987 | WIPO . | |

*Primary Examiner*—3403
*Assistant Examiner*—417/54
*Attorney, Agent, or Firm*—Wenderoth, Lind & Ponack

[57] ABSTRACT

A method of transferring fluent material transfers the material from a first pressure tank to a fluent material transfer destination by supplying compressed gas to the first tank through a compressor. The compressed gas is retained in the first tank for reuse. Additional fluent material is drawn into a second pressure tank and is transferred therefrom to the fluent material transfer destination by supplying the compressed gas from the first pressure tank to the second pressure tank through the compressor. The compressed gas is further retained in the second pressure tank transferring fluent material from the first pressure tank. As the compressed gas is emptied from each tank to the other tank, additional fluent material is drawn into that tank. The cycle can be repeated on a continuous basis to transfer large quantities of fluent material.

15 Claims, 8 Drawing Sheets

METHOD OF TRANSFERRING FLUENT MATERIAL WITH COMPRESSED GAS

This application is a Continuation of now abandoned application, Ser. No. 07/965,781, filed Oct. 23, 1992.

BACKGROUND OF THE INVENTION

1. Field of the Invention

This invention relates to a method of transferring objects with compressed gas, and more particularly to a method of transferring various kinds of objects highly effectively, to many places, including distant places, extending over a wide area. The method employs compressed gas as a transferring medium to repeatedly and continuously transfer the various objects. When the specific gravity of such compressed gas is equal to that of air or the like, problems associated with gravity can be ignored within 1,000 m above the ground, and the air pressure is a wave motion traveling at the velocity of 340 m per second. Accordingly, such natural conditions can be utilized to actively transfer objects.

2. Prior Art

Conventionally, pumps have been used to transfer liquid objects by means of pressure, but their applicability is rather limited to each specific purpose. That is, such pumps are expensive and can effect transfer of only a short distance. Particularly in the case of liquids which contain highly viscous or solid substances, the mechanical durability of a pump is decreased because the structure of the pump allows viscous or solid substances to enter its mechanism, which leads to frequent repairs and replacements of components caused by breakdown and wear. Also, many different pumps are inevitably required for different specific purposes. Thus, pumps are not necessarily sufficient to transfer objects by pressure to specific higher places or distant places. Furthermore, the active power (energy) used for transferring objects cannot be retained as energy. As soon as the transfer is completed, the energy is dispersed. In order to continue further transfer, it is necessary to supply new active power (energy). Naturally, as far as pumps are applied in transferring objects by pressure using present pump mechanisms, the active power cannot be retained for further repeated and continuous use. In addition, there has not yet been provided a complete freeze-prevention measure to prevent pumps and pipes from freezing in winter, due to the excessive costs involved.

In view of these circumstances, the inventor has provided a method of transferring objects, including an Atmospheric Pressure Operation, a Natural Pressure Operation, an Added Pressure Operation, an Alternate Added Pressure Operation, and a Continuous Added Pressure Operation, as disclosed in the International Publication No. WO 90/03322.

An Atmospheric Pressure Operation is a method wherein the air in the atmosphere is compressed to provide active power for use in a transfer operation. For example, a first pressure tank with a capacity of 1 $m^3$ is placed on the ground and filled with water. An empty tank with the capacity of 1 $m^3$ is placed at a level of 100 m above the first tank and is connected to the first tank with a pipe. When a compressor compresses air from the atmosphere and delivers the compressed air continuously at an atm. gauge pressure (pressure) somewhat higher than 10 atm., the water in the first tank gradually flows into the second tank. As a result, the first tank is filled with 1 $m^3$ of compressed air with the pressure somewhat higher than 10 atm., and the second tank is filled with 1 $m^3$ of water. By electronically sensing when this step is completed, the valve at the bottom of the first tank is closed, so that the compressed air can be fully retained without dispersion. Namely, in the Atmospheric Pressure Operation, water is pushed up, using air as a medium of transfer, to the level of 100 m above the first tank, and then the active power used to transfer the water is retained as a replacement for the water (or other objects) in the first tank, i.e., the place where the objects have been transferred from.

A Natural Pressure Operation is defined as an operation where the compressed air, retained in a pressure tank as active power (energy), is utilized by merely opening and closing the valves of the pressure tank, without consuming any other energy such as power required to actuate general machines. For example, when the 1 $m^3$ of compressed air, which has a pressure of a little higher than 10 atm. and is retained in the first tank in accordance with the Atmospheric Pressure Operation, is sent to the second tank filled with 1 $m^3$ of water 100 m above the ground, the total volume of 1 $m^3$ of water in the second tank is pushed up to a third tank 45 m above, in accordance with the Natural Pressure Operation. In this case, the first tank and the second tank each possess compressed air at 4.5 atm. gauge pressure retained after the first transfer process. The total volume of 2 $m^3$ of compressed air at 4.5 atm. gauge pressure is pushed up in accordance with the Natural Pressure Operation to the third tank, and 1 $m^3$ of water in the third tank is pushed up to a fourth tank with a capacity of 1 $m^3$ 26.6 m above. Thus, if the above method using the tank capacity of 1 $m^3$ is used in successive Natural Pressure Operations, the total transfer height that this operation can achieve is 122.19 m. When precisely calculated using integral calculus, 1 $m^3$ of water can be pushed up to the height of 164 m in accordance with the Natural Pressure Operation. Namely, it is proven that the active power of the compressed air required for transferring 1 $m^3$ of water to the height of 100 m in the Atmospheric Pressure Operation is equal to that which can push the water up to the height of 164 m.

An Added Pressure Operation is a method wherein compressed air is taken and compressed by a compressor for use in a transfer operation. An operation in which compressed air, retained as an energy source after the Atmospheric Pressure Operation, is taken and compressed by a compressor, and an operation which utilizes compressed air retained in a receiver tank, can both be called an Added Pressure Operation.

For example, under the condition that 1 $m^3$ of water in the first tank on the ground is pushed up to the second tank 100 m above the ground in accordance with Atmospheric Pressure Operation, the compressed air having an atm. gauge pressure of a little higher than 10 atm. retained in the first tank is taken and compressed to be pushed up to a third tank set 100 m above the second tank by a compressor. At the stage that the water in the second tank is almost sent up to the third tank with exception of a little water remaining inside the second tank, the pressure of the first tank drops to zero atm. gauge pressure, i.e. to the level of the atmosphere. Theoretically, it is possible that the air in the first tank is taken and pushed up into the second tank by further actuating a compressor until the inside of the tank becomes a vacuum. By doing so, all of the remaining water in the second tank is pushed up into the third tank. But the efficiency is badly decreased when a compressor is used to generate negative pressure. Instead, therefore, by electronically sensing the instant the pressure inside the first tank drops to an arm. gauge pressure of zero, or to the level of the atmosphere, the little water remaining in the second tank is pushed up to the third tank in an Atmospheric Pressure Operation. Namely, in this case, both an Added Pressure Operation and an Atmospheric Pressure Operation are used. As this alternative, by electronically sensing the instant the pressure of the first tank drops to the level of the atmosphere, the valve at the bottom of the first tank is opened. Through said valve, supplemental water flows into the first tank, whereby preparing supplemental water while conducting the Atmospheric Pressure Operation is possible. Needless to say, only the Added Pressure Operation enables the transfer of water utilizing the compressed air retained in a receiver tank.

Alternate Added Pressure Operation is a method wherein an object is transferred to a next step tank continuously in Added Pressure Operation by alternate replacement of compressed air and an object in between a plurality of tanks.

For example, two tanks are set in parallel. The first tank is filled with compressed air and the second tank having the same capacity as the first tank is filled with water. First, the compressed air in the first tank is acted against the water in the second tank by a compressor. Then the water in the second tank is sent to a next step. When the transfer is completed, the first tank is filled with water. Next, the compressed air retained in the second tank is acted against the water in the first tank. Thus, by alternately transferring the objects in the first tank and the second tank in Added Pressure Operation, a continuous transfer into a next stage can be made. In this case, also, by utilizing the compressed air prepared in a receiver tank, the whole process of transfer can be conducted in Added Pressure Operation. Continuous Added Pressure Operation is available for further stages, provided a plurality of tanks are set in parallel at each stage so as to be conducted in Alternate Added Pressure Operation.

In methods of transferring objects with compressed gas, Added Pressure Operation, and practical types thereof, such as Alternate Added Pressure Operation and Continuous Added Pressure Operation, are superior in that the energy used for the transfer action can be retained and used for further transfer repeatedly and continuously, as compared to mechanical transferring methods such as witch pumps. However, when transferring the entire amount of the object, after completion of Added Pressure Operation, it is required thereafter to apply Atmospheric Pressure Operation, or to let the remaining object flow in under a little negative pressure, or to conduct Added Pressure Operation utilizing the compressed air retained in a receiver tank prior to the operation. If none of these methods is adopted, then it is required that air is taken by a compressor until the inside of a tank becomes from zero to vacuum.

SUMMARY OF THE INVENTION

It is therefore an object of the present invention to provide a transfer method comprising two cycle systems of a perfect closed type in which compressed air as an active power source is entrapped. One cycle for an Alternate Added Pressure Operation conducts continuous transfer while the other cycle supplements the liquid transfer material. Further, as for adding liquid, the present invention provides a continuous addition method wherein material is taken continuously from outside into the closed cycle utilizing the pressure difference of the compressed air as a medium of transfer so as to provide a more highly effective continuous transfer method.

To accomplish the above objects, two cycle systems of a closed type, comprising compression devices and a plurality of pressure tanks, are set up in accordance with the present invention. In one cycle system, material is transferred continuously to a transfer destination by replacement of material with compressed air, while the other cycle system draws up more material, continuously utilizing the pressure differences, and continuously supplying the drawn material into the former cycle system.

Moreover, in order to recycle compressed air sent to a transfer destination together with the material back to the origin of the transfer, with the aim of utilizing the air as an active power source continuously and repeatedly, the following method is adopted. Namely, there is provided a transfer method wherein the liquid material and the compressed air are fed alternately by a compression device and transferred continuously to a pressure tank set at a transfer destination. The material is discharged to the outside from the bottom of the pressure tank, and the compressed air is drawn up from the top of the tank and returned to the origin of transfer. Thereafter, the compressed air is replaced with liquid alternately for further transfer.

Also, in order to further transfer the transferred material to higher places or to more distant places, the following method is adopted. Namely, there is provided a method wherein a first tank containing a gas at atmospheric pressure receives transferred material by utilizing a pressure difference, and a second tank reserves the material pushed from the first tank by drawing up the gas in the first tank with a compression device, and a third tank is filled with compressed gas which is to be pushed into the second tank by a compression device. Thus, in this method, the atmospheric air is replaced with the object, the object is replaced with compressed air, and the compressed air is replaced with atmospheric air. By such continuous cyclic replacement, the transferred material is further transferred to another place.

By adopting the above respective methods, the method of transferring material with compressed gas becomes more practical and the material can be transferred continuously and more effectively. The material is also supplemented continuously, so that the effectiveness of the continuous method of transferring material increases.

DESCRIPTION OF THE PREFERRED EMBODIMENT

A method of transferring a fixed volume of water while continuously controlling the air pressure and the volume of water by utilizing instruments and sensors is explained as follows. For better understanding, a liquid of specific gravity 1.0 is used. As for the compressed gas, air is used.

Method 1

The transfer is conducted in an Alternate Added Pressure Operation. The supplement of objects or material for continuous transfer is conducted in a Natural Pressure Operation or together with an Added Pressure Operation. Now the method is explained according to FIG. 1.

Utilizing pressure tanks A and B, an Alternate Added Pressure Operation is conducted with the compressed air of a fixed pressure. In order for the Alternate Added Pressure Operation to be conducted continuously with high effectiveness and strength, the addition or filling of objects or material is conducted through pressure tanks C and D, which are specially prepared. The material is pushed into the tanks A and B alternately from the tank C. As for the addition, a Natural Added Pressure Operation is conducted with the compressed air of a fixed pressure between the tanks C and D. If necessary, an Added Pressure Operation is also used. The process of adding material in the Natural Pressure Operation, or in the joint use thereof with the Added Pressure Operation, strengthens the Alternate Added Pressure Operation between the tanks A and B, and obtains a high effectiveness-of the transfer.

[Preparatory Stage]

Figure 1:
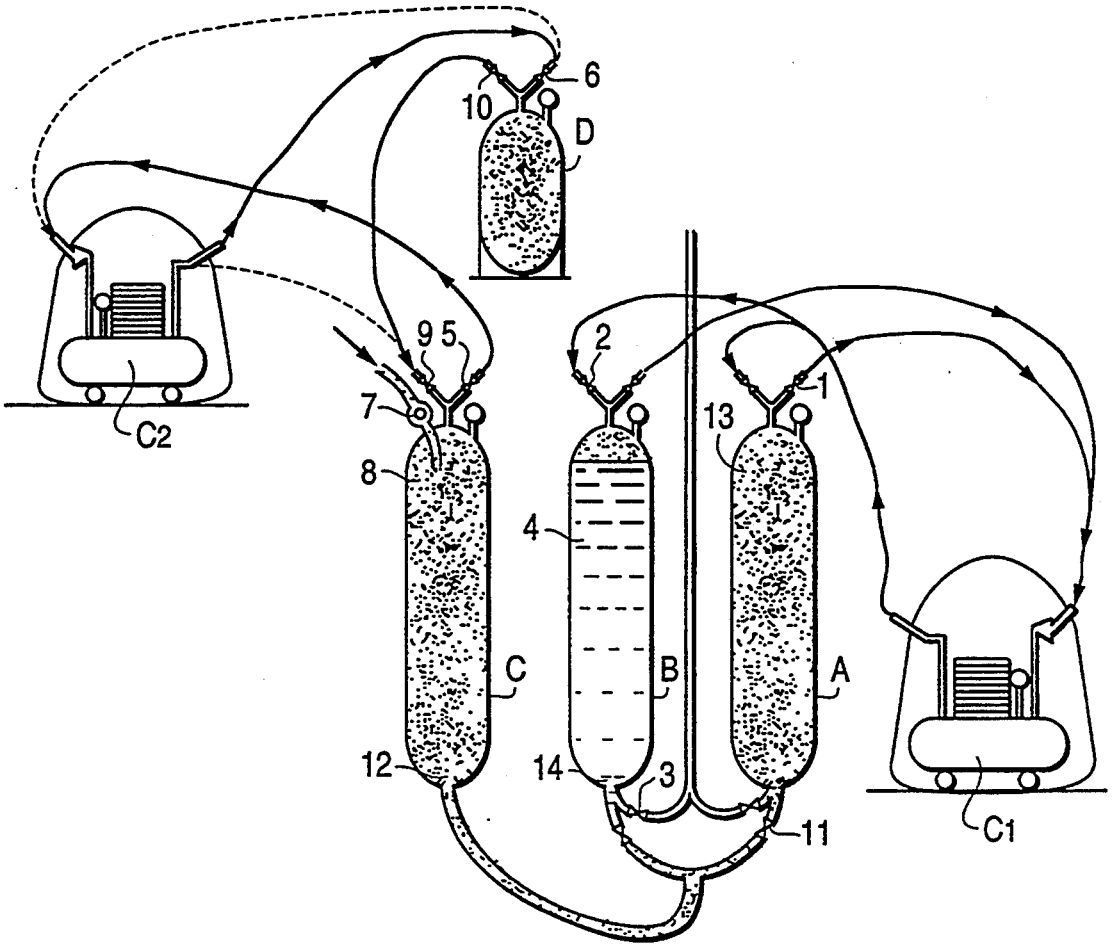
FIG. 1 illustrates one embodiment of a transfer method in accordance with the present invention.

The object or material (liquid of the specific gravity 1.0) is transferred continuously to a place at a level of 100 m above the ground, or to a place 5,000 m away and parallel to the ground with compressed air at a pressure of 11.0 atm. gauge in an Alternate Added Pressure Operation between the tanks A and B. For smooth and highly effective continuous transfer, the addition of material is conducted in Natural Pressure Operation with 8.33–2.5 atm. gauge pressure, and Added Pressure Operation is jointly used, if necessary. In FIG. 1, the capacity of the tank A and the tank B are both 1,100 liters. The unit transfer of the objects is 1,000 liters, so that even when the total amount of liquid is pushed into each tank, there still remains a space of 100 liters in each tank A and B. The capacity of the tank D is 500 liters.

The tank B is filled with 1,000 liters water, and at an upper portion, in which the 100 liter space remains, the compressed air of 2.0 atm. gauge pressure is stored. The tank A with the capacity of 1,100 liters is filled with compressed air of 11.0 atm. gauge pressure.

Provided that the tank A and the tank B are regarded as an integral structure, a PV constant is PV=13,500, wherein the value is unchanged.

(Tank A): PV=(1+11)×1,100 (1=atmospheric pressure)

(Tank B): PV=(1+2)×100 (1=atmospheric pressure)

(Tank A)+(Tank B)=13,500

The tank C and the tank D are both filled with compressed air of 2.5 atm. gauge pressure. Provided that the tank C and the tank D is regarded as an integral structure, PV=5,600, wherein the value is unchanged.

(Tank C): PV=(1+2.5)×1,100

(Tank D): PV=(1+2.5)×500

(Tank C)+(Tank D)=5,600

The reason the 100 liter space is preserved at the upper portion of each of tanks A, B, and C is that, by making an allowance of 10% per 1 $m^3$, control is considered to be fully maintained over the operation. If the control is conducted more precisely, then the space allowance can be decreased, and the effectiveness of transfer becomes greater. All valves to be used are electric valves.

[First Stage]

In a first step, an Alternate Added Pressure Operation is conducted between the tanks A and B by the compressor C1, while the compressor C2 also acts on the air in the tank C to draw the air up into the tank D. A fixed volume of liquid, e.g. 337.5 liters of liquid, is transferred to a transfer place, while the air in the tank C is drawn up between the tank C and the tank D, then the pressure inside of the tank C drops, whereby 1,000 liters of supplementary liquid is filled into the tank C. Thus, the first step is completed.

Here, an Alternate Added Pressure Operation conducted between the tank A and the tank B is explained. A valve 1 and a valve 2 of the tank B are opened. The compressor C1 acts on the compressed air of 11.0 atm. gauge pressure in the tank A to be pushed into the tank B. Then the valve 3 of the tank B is opened, and the 1,000 liters of liquid in tank B is transferred to a transfer place.

Accordingly, as the liquid in the tank B is transferred to a transfer place, the level of the liquid comes down, and the upper space of the tank B enlarges more than a 100 liter volume. The pressure of the upper space is initially 2.0 atm. gauge pressure, and then the pressure rises to 11.0 atm. gauge pressure while the Added Pressure Operation is continued. On the other hand, the compressed air of 11.0 atm. gauge pressure in the tank A gradually lowers as the compressed air of the tank A is transferred into the tank B. Sensing with a level switch 4 in the tank B the instant when 337.5 liters of liquid, out of the initial volume of 1,000 liters in the tank B, has been transferred, or sensing by utilizing an applicable control means the instant when a pressure gauge at the tank A indicates 6.5 atm. gauge pressure, the first stage is finished.

The PV value of Tank A+Tank B is:

$$(1+6.5)\times 1{,}100+(1+11)\times(100+337.5)=13{,}500$$

According to the Added Pressure Operation between the tanks A and B, 337.5 liters out of the 1,000 liters in the tank B is transferred to a transfer place. Within the time the pressure inside the tank A drops to 6.5 atm. gauge pressure, namely, prior to the completion of the first stage, the following process, i.e., an addition of 1,000 liters liquid to fill the tank C, is conducted. To do so, first the operation of having the tank D draw up the air in the tank C is conducted with the concurrence of Alternate Added Pressure Operation between the tanks A and B. In more detail, at the same time the Added Pressure Operation between the tanks A and B with the compressor C1 starts, the valve 5 of the tank C and the valve 6 of the tank D are opened. Then the compressor C2 operates to push the compressed air of 2.5 atm. gauge pressure in the tank C into the tank D. The pressure of the tank C drops rapidly. When the pressure from the outside caused by supplementary liquid, which is supported by the pressure valve 7, exceeds the pressure inside the tank C, the pressure valve 7 is pushed downward and the supplementary liquid flows into the tank C.

The compressor C2 continues to draw up the air inside the tank C, while the inflow of the supplementary liquid pushes up the air inside of the tank C from the bottom to the upper portion. Accordingly, the operation of the compressor C2 for pushing the air in the tank C into the tank D becomes more and more effective.

Sensing with a level switch 8 the instant when the 1,000 liters of supplementalary liquid for the tank C starts to flow, the compressor C2 stops its operation. At the same time, when the valve 5 and the valve 6 are closed, a valve 9 of the tank C and a valve 10 of the tank D are opened. Then the high pressure air in the tank D flows rapidly into the upper space of the tank C. Immediately the pressure valve 7 is pushed upward, so that the inflow of supplementary liquid is prevented. As a result, an upper space with a 100 liter volume of the tank C and the tank D are both filled with compressed air having 8.33 atm. gauge pressure. If necessary, from the viewpoint of control, pressure gauges of the tank C and the tank D may sense this instant.

The PV value of Tank C+Tank D is

PV=5,600 (unchanged,)

$(1+Pcdx)\times 100+(1+Pcdx)\times 500=5,600$

Pcdx=8.33 atm. gauge pressure

[Second Stage]

1,000 liters of supplementary liquid is already in the tank C, the upper space of which is pressured with 8.33 atm. gauge pressure, as explained above. The 337.5 liters of liquid in the tank B, in the Added Pressure Operation, has been transferred to a transfer place, and,, in the tank A, the initial 11.0 atm. gauge pressure due to Added Pressure Operation has dropped to 6.5 atm. gauge pressure. Sensing this instant, the valve 11 at the bottom of the tank A is then opened. The supplementary liquid in the tank C is strongly pushed into the tank A through the bottom of the tank A with the compressed air of 8.33 atm. gauge pressure, preserved in the upper space of 100 liters volume in the tank C and in the tank D of a capacity of 500 liters volume. It is, of course, possible to transfer the liquid in the tank B to a transfer place with only the Alternate Added Pressure Operation between the tanks A and B. To accelerate the operational speed thereof, however, the supplementary liquid is used, pushing the liquid with 8.33 atm. gauge pressure through the valve 11 at the bottom of the tank A into the compressed air in the tank A, which becomes decreased 6.5 atm. gauge pressure below.

The Natural Pressure Operation between the tanks C and D for pushing the supplementary liquid to the tank A is explained. The initial 8.33 atm. gauge pressure in the tanks C and D decreases as the supplementary liquid of 1,000 liters in the tank C is pushed into the tank A through the valve 11. At the point that the 1,000 liters of supplementary liquid has all been pushed out and the tank C becomes empty, the pressure of the tanks C and D drops to 2.5 atm. gauge pressure. This instant can be sensed by a level switch 12 at the tank C and a level switch 13 at the tank A. Pressure gauges at the tanks C and D also can sense this instant. Sensing this instant, the valve 11 at the tank A is then closed. The pressure changes with respect to the tanks C and D is as follows.

The initial PV value of Tank C+Tank D is

PV=5,600 (unchanged,)

$(1+Pcdx)\times 100+(1+Pcdx)\times 500=5,600$

Pcdx=8.33 atm. gauge pressure

The final PV value of Tank C+Tank D is

PV=5,600 (unchanged)

$(1+Pcdy)\times 1,100+(1+Pcdy)\times 500=5,600$

Pcdy=2.5 atm. gauge pressure

Accordingly, by Natural Pressure Operation between the tanks C and D, 1,000 liters of supplementary liquid is pushed into the tank A, initially with 8.33 atm. gauge pressure and finally with 2.5 atm. gauge pressure.

On the other hand, the efficiency of the Alternate Added Pressure Operation between the tanks A and B becomes greater due to the addition of the supplementary liquid conducted in Natural Added Pressure Operation between the tanks C and D, so that 662.5 liters of liquid remaining in the tank B is pushed up to a transfer place with an accelerated speed. The level switch at the tank B senses the instant that the liquid and the valve 3 at the tank B is closed. It is needless to say that the pressure inside the tank B is 11.0 atm. gauge pressure, since the Added Pressure Operation with 11.0 atm. gauge pressure has been completed.

The tank A is filled with 1,000 liters of supplementary liquid, and, at the upper portion thereof, the space with the capacity of 100 liters is 2.0 atm. gauge pressure. The PV value of the tanks. A and B is;

PV=13,500 (unchanged)

$(1+Pcdz)\times 100+(1+11)\times 1,100=13,500$

Pcdz=2.0 atm. gauge pressure

Accordingly, it is clear, in this second stage, that the Natural Pressure Operation between the tanks C and D supports the Alternate Added Pressure Operation between the tanks A and B, initially with $(8.33-6.5)=1.83$ atm. gauge pressure, and finally with $(2.5-2.0)=0.5$ atm. gauge pressure.

Consequently, the tank A is filled with 1,000 liters of liquid material, and the upper space, with the capacity of 100 liters is filled with compressed air at 2.0 atm gauge pressure. The tank B is filled with compressed air with 11.0 atm. gauge pressure. Both the tank C and the tank D are filled with compressed air of 2.5 atm. gauge pressure. This indicates that the tanks A and B have been effectively completely replaced with each other from the preparatory stage. The tanks A and B have pipes for conducting the Added Pressure Operation at the stage when the above replacement is completed. Valves and level switches are also provided. Accordingly, by repeating such processes, Alternate Pressure Operation between the tanks A and B is conducted while the supplementary liquid is transferred in a Natural Pressure Operation between the tanks C and D. Thus, a continuous operation can be conducted with a high efficiency.

In the above case, an Added Pressure Operation between the tanks C and D is also possible. The process until the first stage is the same. In the second stage, however, if the pipe connected between the valve 9 at the tank C and the valve 10 at the tank D is sufficiently large, and, in addition, Natural Pressure Operation can fully conduct the process, without the need for the compressor C2, arranged for supporting the Added Pressure Operation between the tanks A and B, then there is no need to adopt such an Added Pressure Operation. Therefore, the adoption of an Added Pressure Operation depends on the type of and properties of the liquid material or on the need for greater efficiency.

If an Added Pressure Operation between the tanks C and D is adopted, then the piping is as illustrated in FIG. 1 by dotted lines. The valve 10 is closed in the manner of conducting the Natural Pressure Operation between the tanks C and D. The compressed air in the tank D is strongly pushed into the tank C through the compressor C2, from the opened valve 6 to the valve 9 at the tank C. The gauge pressure of the tank D drops further and, in inverse proportion thereto, the gauge pressure of the tank C rises, and thus the Added Pressure Operation between the tanks A and B is accelerated. The operation of the tank D with a negative (less than atmospheric) pressure decreases the operational efficiency, so that the pressure of the tank D is controlled to drop only to the atmospheric level. In the case of the Natural Pressure Operation between the tanks C and D, the Alternate Added Pressure Operation between the tanks A and B is initially supported with 1.83 atm. gauge pressure and finally with 0.5 atm. gauge pressure.

On the other hand, in the case of the Added Pressure Operation between the tanks C and D, the initial gauge pressure supporting the Alternate Pressure Operation between the tanks A and B is 1.83, as in the case of Natural Pressure Operation between the tanks C and D, but the final gauge pressure rises up to $(3.64-2.0)=1.64$. As a result, it is possible that the Added Pressure Operation can consistently support the Alternate Added Pressure Operation with 2.0 atm. gauge pressure or less. The final PV value of Tank C+Tank D is $PV=5{,}600$ (unchanged)

$(1+Pcz)\times 1{,}100+(1+0)\times 500=5{,}600$

Pressure of the tank C: $Pcz=3.64$ atm. gauge pressure

Method 2

Figure 2:
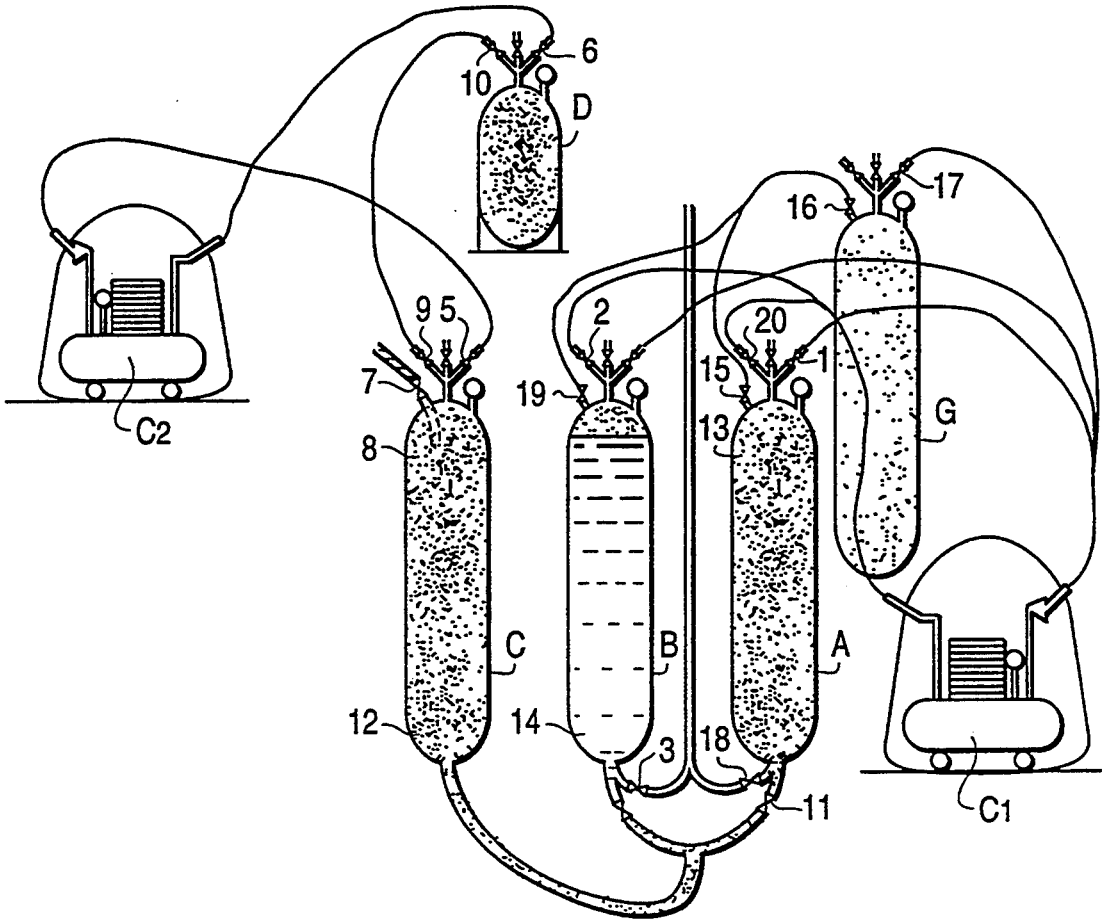
FIG. 2 illustrates a second embodiment of the transfer method in accordance with the present invention.

The present method applies a receiver tank G to the Alternate Added Pressure Operation between the tanks A and B. The method is explained with reference to FIG. 2.

The compressor used in the above Method 1 is a booster compressor which draws up compressed air and discharges it as well as the atmospheric air. Both the inlet pressure and the discharge pressure of the booster compressor are controlled to be 11.0 atm. gauge pressure in Method 1. However, in actuality, the discharge pressure of the booster compressor is 10.0 atm. gauge pressure as a maximum, and the inlet pressure is lower than that of the discharge pressure. For example, in general, the inlet pressure of a booster compressor is 6.0 atm. gauge pressure. In the present method, the booster compressor C1 has an inlet pressure of 6.0 atm. gauge pressure as a maximum and a discharge pressure of 10.0 atm. gauge pressure as a maximum.

[Preparatory Stage]

The tank A, of a capacity of 600 liters, is filled with compressed air of 10.0 atm. gauge pressure. The tank B, having the same capacity as the tank A, is filled with 550 liters of liquid. The upper portion of the tank B has compressed air of 1.0 atm. gauge pressure preserved therein. The receiver tank G, with a capacity of 600 liters, is filled with compressed air of 1.0 atm. gauge pressure. Provided the tanks A, B and G are regarded as an integral structure, PV constant is 7,900, which is unchanged.

(Tank A) $PV=(1+10)\times 600$ (Tank B) $PV=(1+1)\times 50$ (Tank G) $PV=(1+1)\times 600$ (Tank A)+(Tank B)+(Tank G)=7,900

As for the tank C, with a capacity of 600 liters, and the tank D, with a capacity of 400 liters, provided both the tanks C and D are filled with compressed air of 2.5 atm. gauge pressure, their PV constant is 3,500, which is unchanged.

(Tank C) $PV=(1+2.5)\times 600$ (Tank D) $PV=(1+2.5)\times 400$ (Tank C)+(Tank D)=3,500

[First Stage]

In this first stage, a valve 15 of the tank A and a valve 16 of the tank G are opened, so that the tank A and the tank G are connected. Then a valve 17 of the tank G and the valve 2 of the tank B are opened. Through the compressor C1, the compressed air in the tank B is drawn up to act on the upper space of 50 liters in the tank B for transfer, while the compressor C2 is also actuated, and compressed air of 2.5 atm. gauge pressure in the tank C is drawn up into the tank D. First, an Alternate Added Pressure Operation between the tanks A and B is explained.

The compressor C1 draws up the compressed air of 1.0 atm. gauge pressure in the tank G. The compressed air with 10.0 atm. gauge pressure the tank A flows into the tank G, so that the pressure inside the tank G rises within a range not exceeding 5.5 atm. gauge pressure. On the other hand, the pressure inside the tank A also drops rapidly. At the moment the gauge pressure indicates 5.5 atm. gauge pressure, the valves 15 and 16, which connect the tank A and G, are closed. The valve 1 at the tank A is opened, and the compressed air in both of the tanks A and G, both of which are below 5.5 atm. gauge pressure, is pushed into the tank B in Added Pressure Operation. The pressure of the compressed air of 1.0 atm. gauge pressure at the upper portion of the tank B rises rapidly. When the pressure exceeds 9.0 atm. gauge pressure, the valve 3 at the bottom of the tank B is opened, and 550 liters of liquid is pushed into a transfer place with 10.0 atm. gauge pressure, at maximum. In the present method, there is no need to sense the inflow of 337.5 liters, which is a measure indicating the point of addition of supplementary liquid.

Alternate Added Pressure Operation between the tank A and the tanks G and B begins, and at the same time the addition of supplementary liquid starts. Now the process of adding the supplementary liquid is explained.

First, the vale 5 at the tank C and the valve 6 at the tank D are opened. The compressor C2 is actuated to push the compressed air of 2.5 atm. gauge pressure in the tank C into the tank D. The pressure inside the tank C drops rapidly. When the atm. gauge pressure in the tank C is 0.2 atm. gauge pressure, the valve 7 of the tank C is opened, and supplementary liquid flows into the tank C. As soon as the level switch 8 senses the instant 550 liters of supplementary liquid has flowed into the tank C, the valve 7 is closed and the operation of the compressor C2 ceases. Then the valves 5 and 6 are closed, and the valve 9 at the tank C and the valve 10 at the tank D are opened. The high pressure air in the tank D flows into the upper portion of the tank C. At this point, the upper portion of the tank C, with the capacity of 50 liters, and the tank D are both filled with compressed air of 6.78 atm. gauge pressure.

(Tank C) $PV=(1+Pcdx)\times 50$ (Tank D) $PV=(1+Pcdx)\times 400$ (Tank C)+(Tank D)=3,500

$Pcdx=6.78$

Immediately after the pressure gauge at the tank C senses the above instant, the valve 11 at the bottom of the tank A is opened, and supplementary liquid flows into the tank A through its bottom. In the case of the Alternate Added Pressure Operation between the tank A and the tanks G and B, the initial gauge pressure of the tank A, as a drawing up tank, and the inlet pressure from the tank G, are both 5.5 atm. gauge pressure. Accordingly, when the supplementary liquid of 550 liters flows with a 6.78 atm. gauge pressure from the tank C, the pressure of the tanks A and G both drop down below 5.5 atm. gauge pressure within a proper range. Then the supplementary liquid addition process operates to promote the Alternate Added Pressure Operation between the tank A and the tanks G and B. At the point that the supplementary liquid rises and the amount reaches 550 liters, the level switch 14 senses that instant, and the valve 3 at the tank B is closed, while a valve 18 at the bottom of the tank A is opened. At this point, the air pressure of the upper portion, with the capacity of 500 liters, of the tank A and the tank G are both 1.0 atm. gauge pressure. Thus, the first stage is completed and the second stage starts. At the point when the first stage is completed, the contents of the tanks A and B have been switched from the preparatory stage. Nothing has changed in other points.

[Second Stage]

In this second stage, the valve 19 at the tank B and the valve 16 at the tank G are opened to connect the tank B and the tank G. The valve 17 at the tank G and the valve 20 at the tank A are opened. Through the compressor C1, the compressed air in the tank G is taken to act on the upper portion having the capacity of 50 liters in the tank A. While conducting the Alternate Added Pressure Operation, the compressor C2 also operates as in the case of the first stage. An Added Pressure Operation between the tanks C and D is also available.

[Third Stage]

In this third stage, the operations return to the first stage, and the aforesaid process are repeated continuously for transfer of the material.

It is noted that the valve disposed at the intermediate point of the top of each tank is an inlet valve, which is used when the pressure drops down below a fixed point due to, e.g., blow-by.

Method 3

Figure 3:
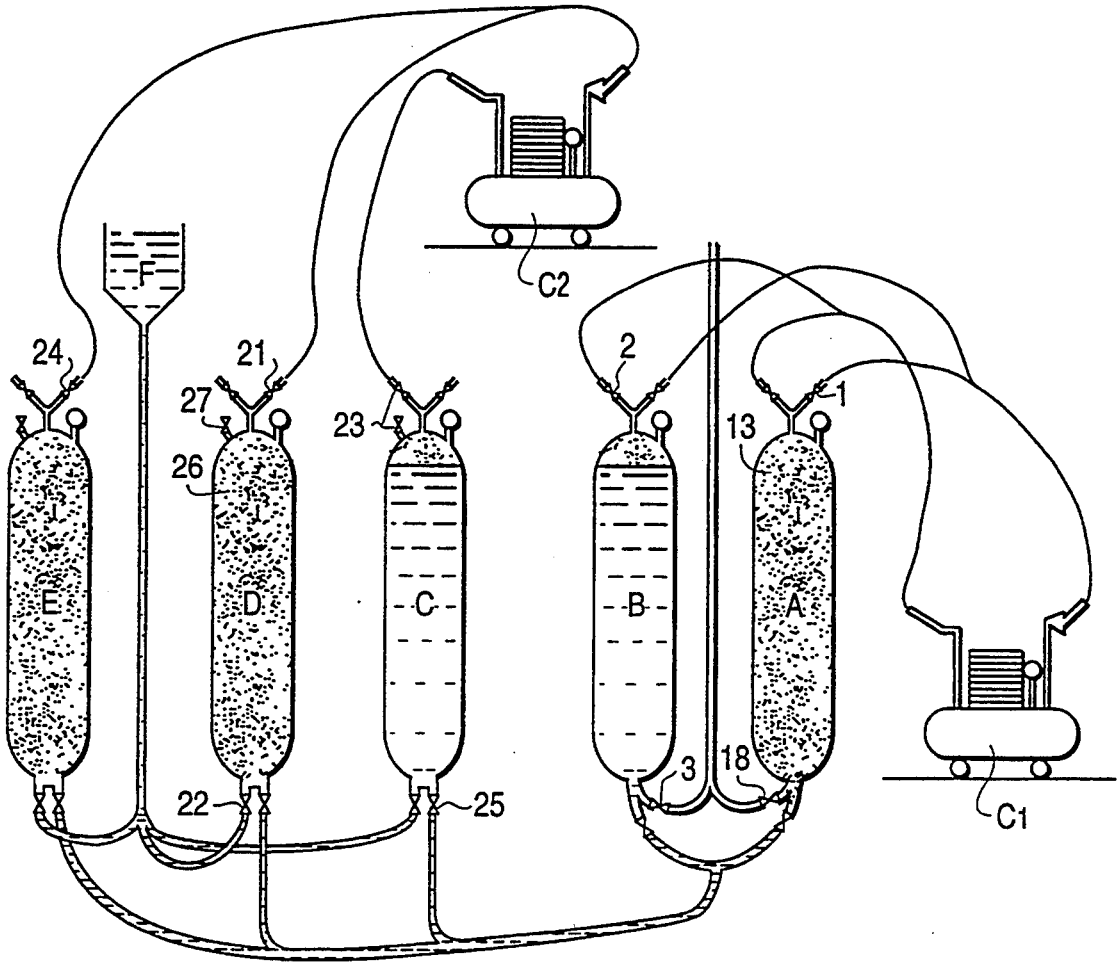
FIG. 3 illustrates a third embodiment of the transfer method in accordance with the present invention.

In this method, both transfer and addition of material are conducted in an Alternate Added Pressure Operation. Now this method is explained according to FIG. 3 as follows.

Addition of liquid in the Alternate Added Pressure Operation can be conducted with the same method as in the above method of transferring between the tanks A and B. But here, a transformed Alternate Added Pressure Operation utilizing the three tanks C, D and E is explained.

[Preparation Stage]

The material (a liquid of a specific gravity of 1.0) is transferred continuously to a place at a level of 100 m above the ground or to a place 10,000 m distant parallel to the ground with compressed air of 1.0 atm. gauge pressure in Alternate Added Pressure Operation between the tanks A and B. To conduct a continuous transfer smoothly and highly effectively, the addition of the material is conducted with an atm. gauge pressure of 11.0 in a transformed Alternate Added Pressure Operation between the tanks C, D and E.

Each of the tanks A, B, C, D and E have a capacity of 1,100 liters, respectively. The unit of transfer is to be 1,000 liters, so that at the upper portion of each tank a space with a capacity of 100 liters remains. The tank B is filled with 1,000 liters of liquid. At the upper portion thereof, there remains compressed air of 2.0 atm. gauge pressure. The tank A with the capacity of 1,000 liters is filled with compressed air of 11.0 atm. gauge pressure. The PV constant of Tank A+Tank B is 13,500.

The tank C is filled with 1,000 liters of liquid, and at the upper portion thereof, there remains a space at atmospheric pressure, i.e. an atm. gauge pressure of zero. The tank D is filled with compressed air at atmospheric pressure, and the tank E is filled with compressed air of 11.0 atm. gauge pressure. The piping from a tank F to the bottom of each tanks C, D and E is provided for adding the liquid material.

[First Stage]

In the first stage, Alternate Added Pressure Operation between the tanks A and B uses the compressor C1, and at the same time the compressor C2 is actuated to add 1,000 liters of liquid to the tank A in Added Pressure Operation and to supply additional liquid from the tank F to the tank D.

First the Alternate Added Pressure Operation between the tanks A and B is explained. As explained previously, the valve 1 at the tank A and valve 2 at the tank B are opened. Utilizing the compressor C1, the compressed air with 11.0 atm. gauge pressure in the tank A is pushed up into the tank B. The valve 3 at the bottom of the tank B is opened and 1,000 liters of liquid is transferred to a transfer place in Added Pressure Operation. Each of the tanks A and B has a level switch for measuring an upper boundary, but there is no level switch provided for measuring a low boundary and a level of 337.5 liters at an intermediate point in the transfer. Namely, the inflow amount of 337.5 liters is not sensed, and the total amount of 1,000 liters is directly transferred in the first stage. Next, the process of adding supplementary liquid between the tanks C, D and E, which is conducted at the same time as the Alternate Added Pressure Operation between the tanks A and B, is explained.

Alternate Added Pressure Operation between the tanks A and B starts, and, at the same time, the valve 21 and 22 at the tank D and the valve 23 at the tank C are opened and the compressor C2 starts to operate. The additional liquid in the tank F flows easily by natural flow. But, since the valve 21 at the tank D is opened and the compressed air of atmospheric pressure in the tank D is pushed up through the compressor C2 into the upper portion having the 100 liter space in the tank C, the pressure of the narrow upper space originally at atmospheric air pressure rises rapidly to 10.0 arm. gauge pressure. Sensing that instant, the valve 21 at the tank D is closed and the valve 24 at the tank E is opened. The compressor C2 acts on the compressed air of 11.0 atm. gauge pressure in the tank E to push air into the tank C, and at the same time, the valve 25 at the bottom of the tank C is opened to transfer the supplementary liquid to the tank A in Added Pressure Operation.

A chain of processes is now explained for each tank. First, the valve 21 at the tank D is opened. Through the compressor C2, the air at atmospheric pressure in the tank D is pushed into the upper portion of the tank C. The pressure of the tank D would drop, but as the valve 22 at the bottom of the tank D is opened at the moment the valve 21 is opened, the supplementary liquid in the tank F flows by natural flow into the tank D, through the bottom, thereby pushing up the air above. Then the air pushed up is moved through the compressor C2 into the upper portion of the tank C. As a result, the inflow speed of the supplementary liquid is quite rapid. Before the succeeding added pressure operation between the tanks C and E starts, 1,000 liters of supplementary liquid flows into the tank D. Depending on the type of supplementary liquid, e.g. highly viscous substances which will delay the inflow speed, it may be necessary to promote the inflow by pressurizing the upper portion of the tank F. Sensing the instant the upper space of the tank C reaches 10.0 atm. gauge pressure with the pressure of the air of atmospheric pressure in the tank D, the valve 21 at the tank D is closed. If there occurs no blow-by, at that point, 1,000 liters of supplementary liquid flows into the tank D, and an upper boundary level switch at the tank D senses that instant. At this time the upper space, with the capacity of 100 liters, in the tank D is at atmospheric pressure. But, if the pressure gauge at the tank D senses that the upper portion of the tank D is at slightly less than atmospheric pressure due to blow-by, etc., a valve 27 at the tank D is opened to draw in the atmosphere. When the pressure gauge senses atmospheric pressure, the valve 27 is closed. At this point, the phase of the tank D is the same as the tank C in the preparatory stage.

As for the tank C, when the air of atmospheric pressure in the tank D is pushed up and moved through the compressor C2 into the tank C through the valve 23, the pressure of the upper space of the tank C rises rapidly. At the moment the pressure gauge senses 10.0 atm. gauge pressure, the valve 21 at the tank D is closed, and the valve 24 at the tank E and the valve 25 at the tank C are opened so as to transfer the compressed air of 11.0 atm. gauge pressure in the tank E in Added Pressure Operation.

As for the tank E, the compressed air of 11.0 atm. gauge pressure in the tank E is transferred in Added Pressure Operation through the compressor C2, from the valve 24 at the tank E to the valve 23 at the tank C, to act on the 1,000 liters of liquid in the tank C. Since the upper space, with the capacity of 100 liters, has already reached 10.0 atm. gauge pressure, and the valve 25 is opened, the supplementary liquid flows, with the gauge pressure exceeding the air pressure inside the tank A, into the tank A through the bottom of the tank A. At this point, let us check the progress regarding the Alternate Added Pressure Operation between the tanks A and B.

The upper space with the capacity of 100 liters in the tank B is initially compressed at 2.0 atm. gauge pressure. Then the compressed air of 11.0 atm. gauge in the tank A flows in, and the pressure of the upper space rises immediately up to 11.0 atm. gauge pressure. 1,000 liters of liquid is transferred to a transfer place through the valve 3. In proportion to the volume of the transferred liquid, the pressure inside the tank A drops from 11.0 atm. gauge pressure, and the speed of the Added Pressure Operation decreases according to the decreasing air pressure. To avoid this, the supplementary liquid is pushed up, with the gauge pressure not below 11.0 atm. from and into the bottom of the tank A in order to support the Added Pressure Operation between the tanks A and B. This resembles the following: passenger cars A and B are full of passengers and ascend a slope with full rotation of engine, while passenger cars C and E, with no passengers, having more efficiency support of the above A and B with full rotation of engine.

As in the case of the tanks C and D in Methods 1 and 2, the tanks C, D and E in this method can be regarded perfectly as a closed cycle. Namely, in the first stage, the tank D is full of air at atmospheric pressure, and then the tank D succeeds to, under compression of the atmospheric pressure or full of the atmospheric air, the phase of the tank C in the preparatory stage. Thus, there is no difference with the phase conversion within a closed cycle.

When the upper boundary level switch 13 at the tank A senses the instant the total volume of 1,000 liters in the tank C has been added to the tank A, the valve 25 at the tank C is closed. At that point, the tank C is filled with compressed air of 11.0 atm. gauge pressure, and the pressure of the tank E drops to the level of the atmospheric pressure. And in the tank A, 1,000 liters of liquid is filled therein, and the upper space thereof, with the capacity of 100 liters, is pressurized by compressed air of 2.0 atm. gauge pressure. The tank B is filled with compressed air of 11.0 atm. gauge pressure. This means that the contents of the tanks A and B in the preparatory stage are replaced with each other. Likewise, replacements take place between the tanks C, D and E: the tank C replaces the tank E, and the tank C is filled with compressed air of 11.0 atm. gauge pressure; the tank D replaces the tank C, and the tank D is filled with 1,000 liters of liquid with the exception of an upper space of a capacity of 100 liters; and the tank E replaces the tank D, and the tank E is filled with atmospheric air.

The second stage is conducted with the tanks replacing each other as discussed above, and the process proceeds similar to the first stage. When the second stage is completed, the operational process between the tanks A and B returns to the first stage. However, the operational process between the tanks C, D and E enters into a third stage, under these conditions: the tank C is filled with atmospheric air; the tank D is filled with compressed air of 11.0 atm. gauge pressure; and the tank E is filled with 1,000 liters of liquid, with the exception of an upper space with a capacity of 100 liters. When the third stage is completed, the process at last returns to the conditions of the preparatory stage. The subsequent fourth stage operates similarly to the first stage.

Method 4

Figure 4:
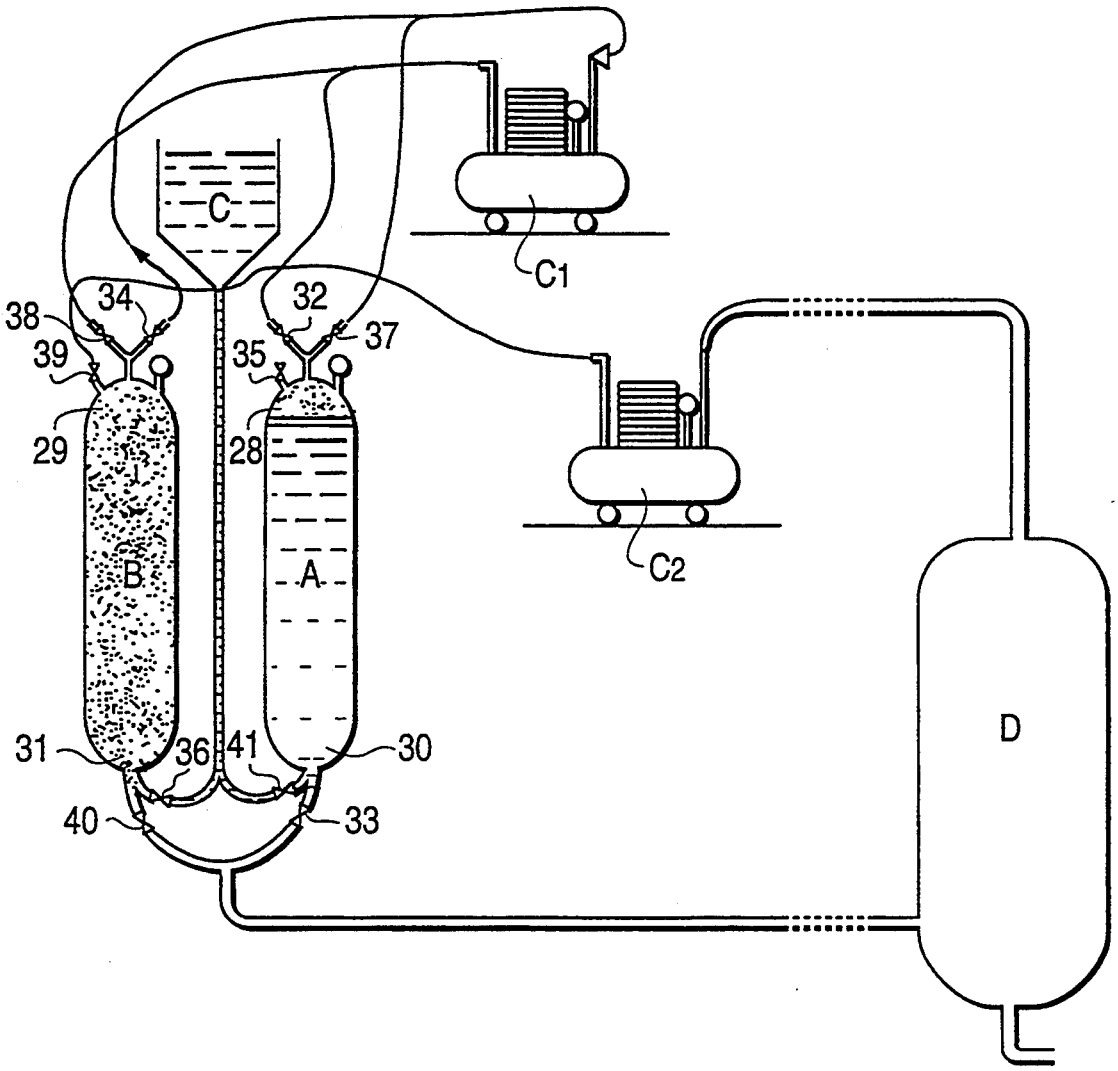
FIG. 4 illustrates a fourth embodiment of the transfer method in accordance with the present invention.

In this method, compressed air used for transfer by pressure is utilized, travelling a long distance, as an active power source. The compressed air is circulated between the origin of the transfer material and a transfer place to which the material is being transferred through a pipe connecting the two points. The process is explained with reference to FIG. 4.

By pressurizing the atmospheric air, compressed air as an active power source is obtained. It is not economical that the active power source disperses to the atmosphere after being used as a power source. The air pressure is wave motion travelling with a velocity 340 m per second, so that the effectiveness of the active power can be promoted if the used active power source is returned immediately from the transfer place to the origin of the transfer for further continuous use in repetition. In this method, the principle is such that the liquid material is transferred from a tank C to the tanks A and B alternately. To support the transfer, the liquid material and compressed air are transferred to the transfer place alternately.

The tanks A and B are both of a capacity of 1,100 liters. The tanks are provided with upper boundary level switches 28 and 29, and lower boundary level switches 30 and 31, respectively. When 1,000 liters of liquid is pushed into the tank A, the volume reaches the upper boundary, so that at the upper portion thereof, a space witch a capacity of 100 liters remains. The upper space is occupied with atmospheric air. The tank B is filled with compressed air at 11.0 atm. gauge pressure.

Valves 32 and 33 at the tank A and a valve 34 at the tank B are opened. The compressed air at 11.0 atm. gauge pressure in the tank B is moved utilizing the compressor C1, and the 1,000 liters of liquid in the tank A is transferred through the valve 33 to a transfer place (a tank D) 5,000 m distant. At the same time, the compressor C2 starts to operate, and gas (atmospheric air) is drawn up and pushed into the tank A through the valve 35. Accordingly, as the liquid in the tank A is discharged into the tank D, the air pressure inside the tank B drops. At the moment a pressure gauge senses, e.g., 0.4 atm. gauge pressure, then a valve 36 is opened and supplementary liquid flows into the tank B from the tank C. When the supplementary liquid reaches the upper boundary, the level switch 29 senses that instant and the valve 36 is closed. When the air pressure of the upper space in the tank B reaches atmospheric pressure, the valve 34 is closed. Thereafter, the compressor C1 continues to draw in atmospheric air and push it into the tank A through the valve 32 at the tank A. The air pressure in the tank D rises, and the compressor C2 draws up the pressurized air so that the inside of the tank D is kept at atmospheric pressure, and then the compressed drawn-up air is pushed into the tank A. Thus, a fixed volume of compressed air is pushed into the pipe, through the tank A, pushing the 1,000 liters of liquid. The control of the volume of compressed air can be accomplished utilizing the operating time of the compressors.

After pushing a fixed volume of compressed air from the tank A to the tank D, the valve 33 is closed. At the same time, the valve 32 at the tank A, the valve 34 at the tank B and the valve 35 at the tank A are closed. Then the valve 37 at the tank A and the valves 38 and 39 at the tank B are opened, and the compressors C1 and C2 start to operate. The compressed air of nearly 11.0 atm. gauge pressure filled in the tank A and the compressed air in the tank D are pushed into the tank B. The valve 40 at the tank B is opened, and the liquid in the tank B is pushed out. Accordingly, as the level of liquid of the tank B descends, the pressure of the tank A also drops. When the pressure in the tank A reaches, e.g., 0.4 atm. gauge pressure, the pressure gauge at the tank A senses that instant and the valve 41 at the tank A is opened. Then the supplementary liquid in the tank C flows into the tank A. At the moment the level switch 28 at the tank A senses the liquid, the valve 41 is closed. When the 100 liters of air occupying the upper space of the tank A reaches atmospheric pressure, the valve 37 is closed, and the compressor C1 continues to draw up atmospheric air and push it into the tank B. After completing the discharge of 1,000 liters of liquid through the valve 40, an Atmospheric Pressure Operation for a certain time, and an Added Pressure Operation, acting on the air in the tank D and utilizing the compressor C2, are conducted continuously. After a fixed amount of compressed air has been pushed into the tank B, the valve 40 is closed. The tank B then returns to the preparatory stage having the conditions prior to the first stage.

Repeating the above transfer steps to the tank D is conducted alternating liquid—compressed air—liquid—compressed air through the inside of the long pipe leading to the tank D. In the tank D, the liquid occupies the lower portion of the tank and the compressed air is at the upper portion of the tank D. The compressed air at the upper portion is drawn out by the compressor C2 so as to keep the upper portion of the tank D at atmospheric pressure. As a result, the pressure difference between the origin of transfer and the tank D can be kept at nearly 11.0 atm. gauge pressure. Since the transfer to the tank D is conducted by the chain of liquid—gas—liquid—gas, the Atmospheric Pressure Operation with the compressor C1 is no longer needed, and the effectiveness of the transfer becomes great. The compressor C1, after completion of the Alternate Added Pressure Operation between the tanks A and B, draws out the gas in the tank D in cooperation with the compressor C2, instead of the Atmospheric Pressure Operation, to push the gas into the tank A or the tank B. Thereafter, the transfer operation is conducted in Added Pressure Operation.

In this method, the distance between the origin of transfer and the tank D is set to be 5,000 m. If the diameter of the pipe transferring the chain of liquid—gas is 200 mm, the inside volume of the pipe becomes 157 $m^3$. Liquid and compressed air are transferred through the inside of the pipe alternately. Provided the volume ratio between the two substances is 2:1, 105 $m^3$ of the liquid in total and 52 $m^3$ of compressed air in total reaches the tank D alternately. In more detail, the length of 1,000 liters of liquid in the pipe having the diameter of 200 mm becomes 32 m, so that the length of the compressed air becomes half the length of the liquid, i.e., 16 m. Accordingly, first liquid with a length of 32 m is transferred, and next compressed air with a length of 16 m follows thereafter, and further liquid with the length of 32 m follows. Thus, a chain of liquid and compressed air extending 5,000 m is transferred to the tank D. Of course, the above volume of the liquid and compressed air inside the pipe is merely divided by simple mathematical calculation. Actually, as the gas approaches the tank D, the pressure of the air drops, and the volume of the gas expands to more than 16 m in length in inverse proportion to the air pressure drop.

After the above process, the Added Pressure Operation acts on the tanks A and B of 1.1 $m^3$ each (1,100 liters) and the compressed air of 52 $m^3$ inside the pipe. During that time, if the air pressure decreases due to blow-by, etc., the compressed air is supplemented according to the circumstances so as to maintain a continuous and repeated smooth transfer, whereby a highly effective operation is attained.

Method 5

There are cases where, after completion of a transfer of a liquid material which includes solid substances of a high specific gravity, or highly viscous liquids, to a very distant place, a further transfer to a higher place or to an even more distant place is needed, or the transferred liquid is to be further divided and transferred to other places. The following method may be applied to such cases. The process is explained with reference to FIG. 5. While any one of the aforesaid methods is available, in this case three tanks are utilized.

[Preparatory Stage]

Figure 5:
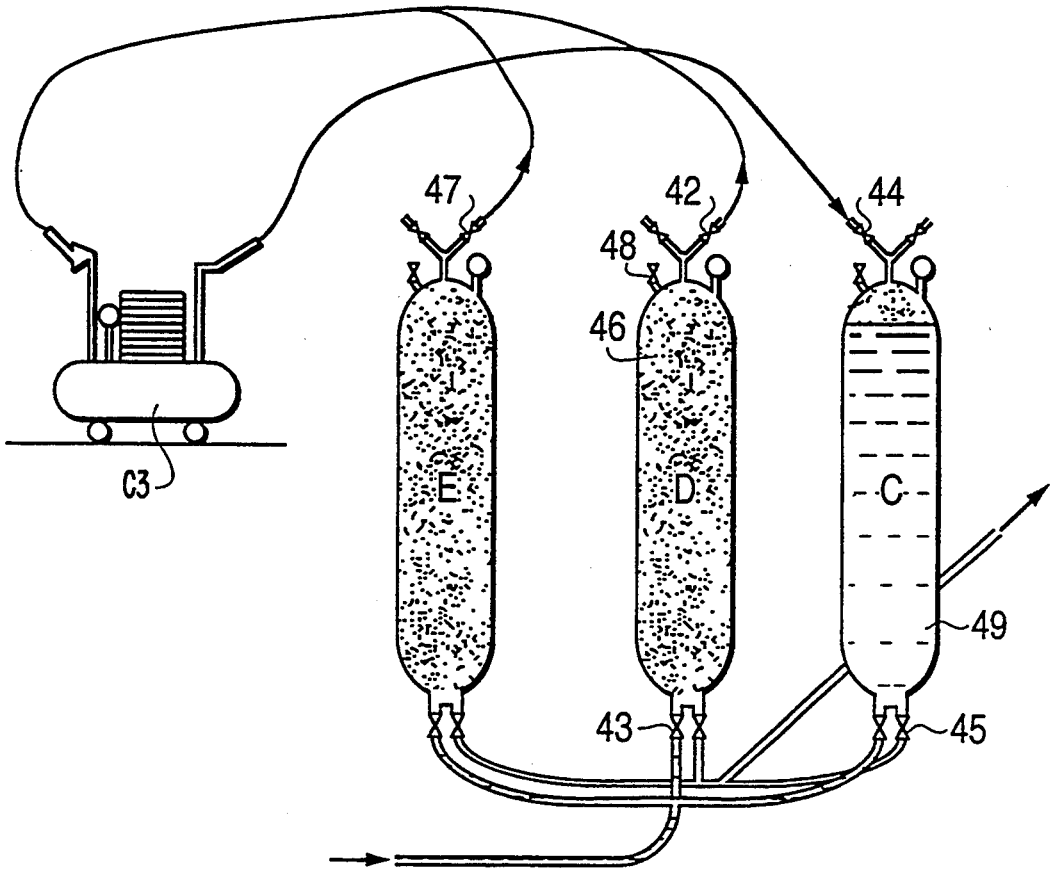
FIG. 5 illustrates a fifth embodiment of the transfer method in accordance with the present invention.
Figure 6:
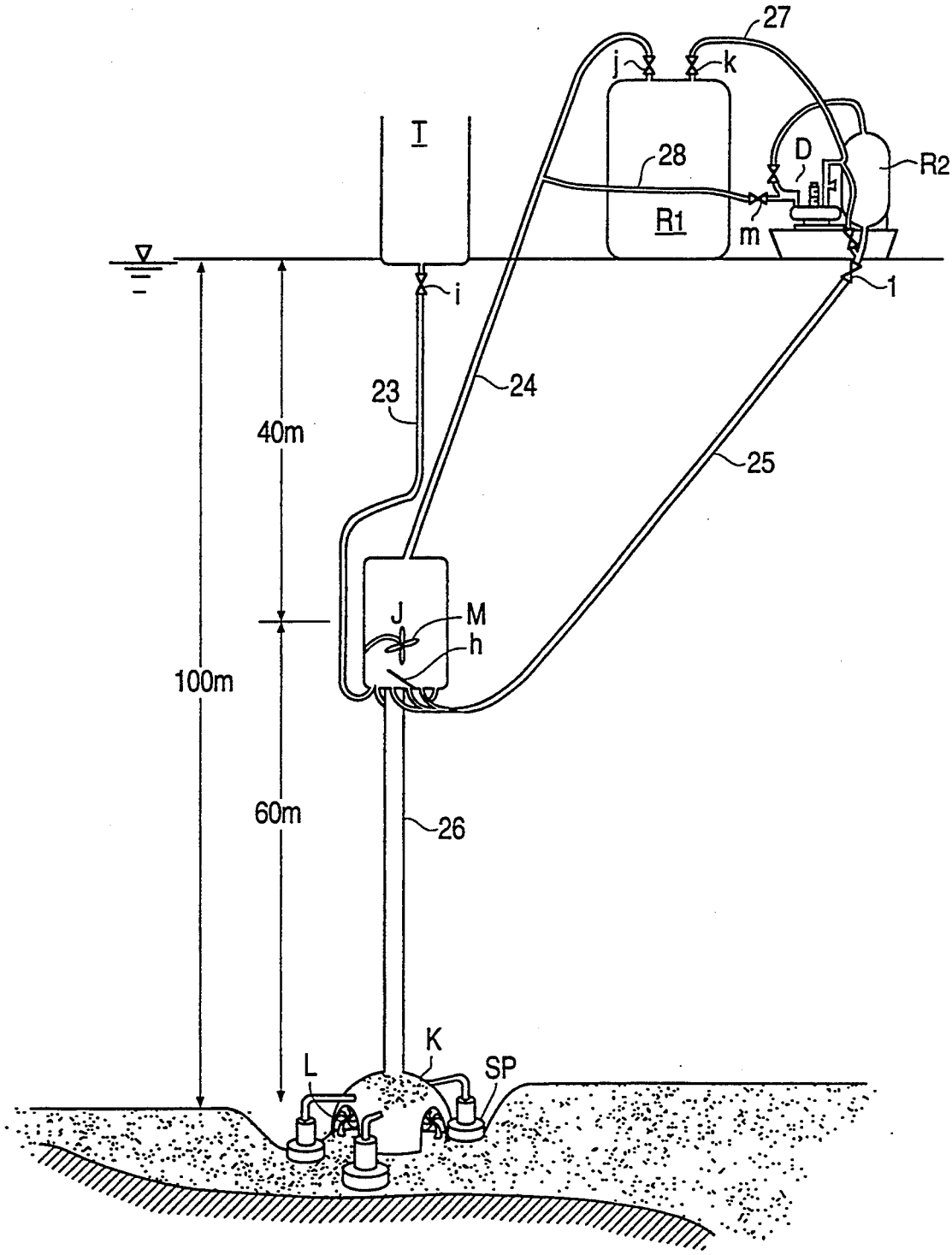
FIG. 6 illustrates a stirring method.

A liquid transferred in an Alternate Added Pressure Operation from the tanks A and B, which are placed at the origin of transfer, is further transferred into the tank C from the direction of arrow A in FIG. 5. The tank C is filled with 1,000 liters of liquid and at the upper portion, a 100 liter space is occupied with atmospheric air. The tank D is filled with 1,100 liters of atmospheric air. The tank E, with a capacity of 1,100 liters, is filled with compressed air at 11.0 atm. gauge pressure (if necessary, the pressure may be varied).

[First Stage]

An upper valve 42 and a lower valve 43 at the tank D, and an upper valve 44 and a lower valve 45 at the tank C, are opened. Then the compressor C3 starts to operate. The liquid from the direction of arrow A, transferred from the origin of transfer, flows into the tank D through the opened valve 43 at the bottom of the tank D. On the other hand, the atmospheric air in the tank D is drawn up by a compressor C3 and is pushed into the upper space of the tank C. Before the pressure inside the tank D becomes negative, liquid is pushed up through the valve 43 at the bottom of the tank D in Atmospheric Pressure Operation between the tanks C and D with an efficiency nearly as in the case of Alternate Added Pressure Operation, so that the inside of the tank D reaches atmospheric pressure or more. The 1,000 liters of liquid in the tank C is transferred through the valve 43 to the next transfer place or to a place from where the transferred liquid is divided. In need of spreading the transferred liquid at the transfer place or the place to be diverged, the valve 45 at the tank C is closed until the air pressure of the upper space in the tank C becomes 11.0 atm. gauge pressure.

When the liquid pushed in to the bottom of the tank D reaches the level of 1,000 liters, a level switch 46 senses that instant, and the valves 42 and 43 are closed. Then a valve 47 at the tank E is opened, and compressed air of 11.0 atm. gauge pressure is transferred from the tank E to the tank C in Added Pressure Operation.

If the air pressure of the upper space, with the capacity of 100 liters, in the tank D becomes negative, the valve 48 is opened until the upper space reaches atmospheric pressure.

The valve 45 is closed by sensing the instant of the completion of transfer of the 1,000 liters of liquid in the tank C with a level switch 49 at the bottom of the tank C. At that point, if the pressure of the tank C does not reach a gauge pressure of 11.0 atm., an Alternate Added Pressure Operation is conducted until the pressure in the tank C reaches 11.0 atm. gauge pressure. Such a reduction of pressure occurs in the tank C because the pressure of the compressed air used for the Alternate Added Pressure Operation is higher than required. Accordingly, the initial gauge pressure of the tank E should be decreased to the extent of necessary and sufficient for transfer.

The first stage is completed through the above processes. The tank C thus replaces; the phased the tank E, and the tank E replaces the phase of the tank D. The second stage starts by repeating the same process, whereby a transfer distance can be further extended, and the division of the material can be attained with a high effectiveness.

The continuous operation in this method is conducted in two systems. The one system includes the tanks A and B, or the tanks A, B and C, which are for the transfer operation. The other system includes the tanks C and D, or the tanks C, D and E, which are for continuous supplement. These tanks are controlled by computers such as micro-computers or micro-processors utilizing a fuzzy function.

Particulars of the liquid material such as the specific gravity, the viscosity, the forms of the substances included in the liquid and the content ratio thereof, the values of friction and resistance, etc., are calculated in accordance with hydrodynamics and experiments. After that, the values obtained are memorized in the computers. When the liquid flows into the supplement system, the sensor senses the properties and forms of the liquid. According to the memory and operation of the computers, the pressure and the volume of transfer of each tank in the two systems are controlled so as to be best suited for the liquid material. A change in the volume of the liquid during a continuous operation over an extended period of time is also able to be properly dealt with by utilizing developed software.

In this method, however, there still remains the problem of blow-by due to the compressor operation. The blow-by problem can be settled, provided the compressor is contained in a suitable pressure box and operated under the same pressure as that of the Added Pressure Operation. But it is necessary to prepare a large-sized pressure box. Recently the abilities of a compressors have become quite great, and as a result the amount of blow-by is small. So it seems more economical, by sensing the instant the amount of the blow-by reaches a fixed value, to supplement the loss instead of preparing a pressure box for containing the compressor.

On the contrary, however, when various kinds of liquid material are transferred to higher places or very distant places by large-sized mechanisms, a plurality of large-sized compressors contained in a large-sized pressure box of steel or in a hermetical RC or SRC structure box with high stability may be considered. The pressure inside of the pressure box can be controlled by computers so as to eliminate blow-by, which is practically possible and economical,, Newtonian fluids and slurries of non-Newtonian fluids as well may be transferred by this method. Solid substances can be included in the fluid in this method as long as the size of the solid substances is smaller than the diameter of the valves and pipes. Accordingly, stirring is required for some kind of liquid in transfer. As for stirring, this process is described in the aforesaid International Publication No. WO 90/03322, wherein compressed air is pushed through a plurality of divergent pipes from the bottom of a tank where stirring is conducted. Bubbles rising up from the bottom of the tank crush the precipitated or coagulated substances, and then compressed air preserved at the upper portion of the tank pushes the stirred liquid into another pipe connected to the bottom of the tank.

Figure 7:
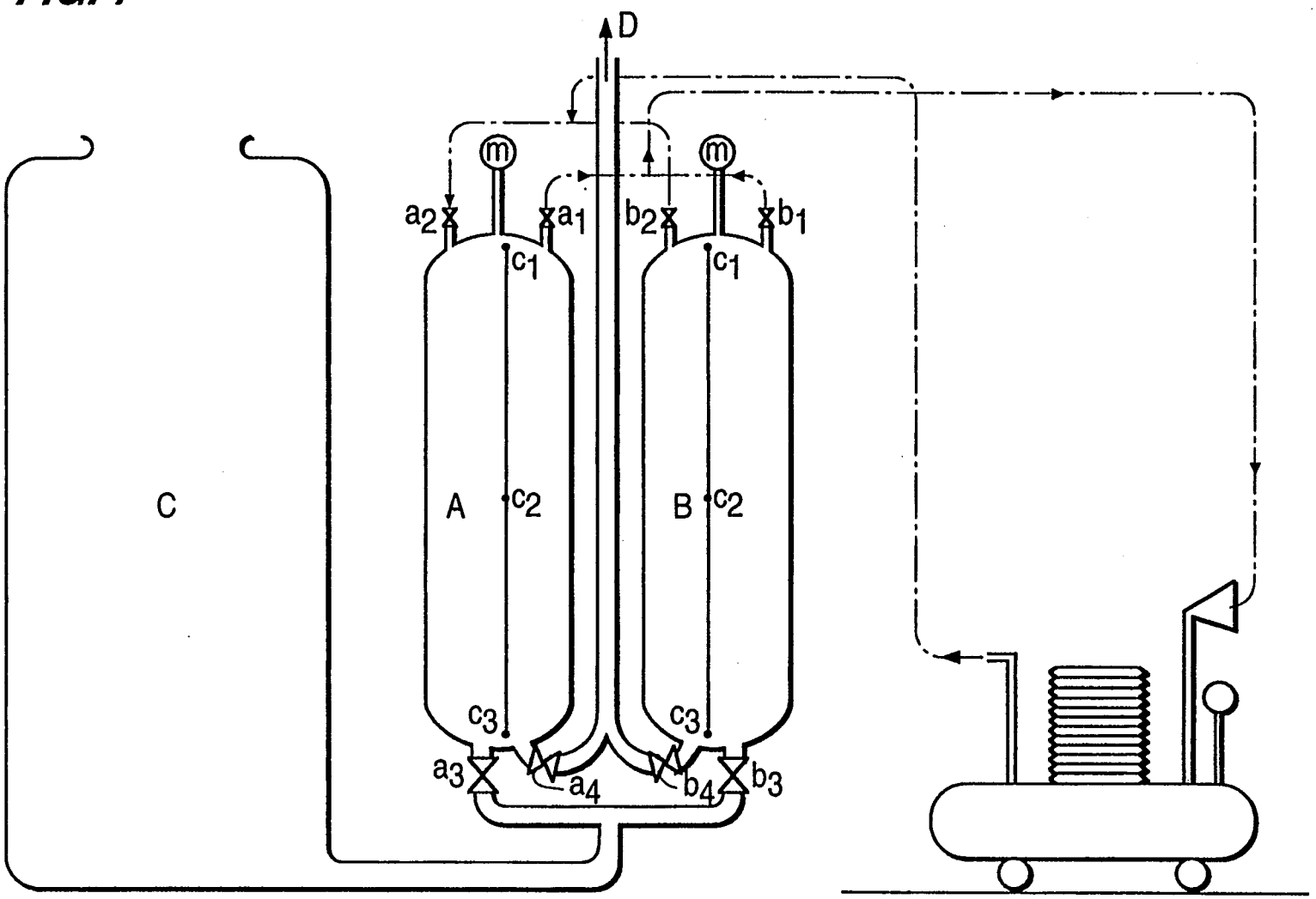
FIG. 7 illustrates an Alternate Added Pressure Operation.

Further explanation of stirring is made with reference to FIG. 7, which is a basic drawing with respect to an Alternate Added Pressure Operation. When compressed air of 10.0 atm. gauge pressure in the tank A is pushed into the tank B and acts on the liquid in the tank B so that the liquid is transferred in a D direction, the valve $b_3$ is opened before the valve $b_4$ is opened. The liquid in the bank B is then returned to the tank C, where the precipitated or coagulated substances are crushed and stirred. Whether all the liquid in the tank B is returned to the tank C, or the liquid is returned partly for stirring, can be adjusted by a position sensor. For stirring, Natural Pressure Operation is enough, but an Added Pressure Operation may be used if necessary. There are several steps to be taken after stirring. One step is that, in the case of the total amount of liquid in the tank B being returned to the tank C, the inside of the tank is filled with compressed air of 10.0 atm. gauge pressure, and the stirred liquid is returned to the tank A, and in the next stage an Alternate Added Pressure Operation is conducted. Another step is that the compressed air in the tank B is again returned to the tank A so that the inside of the tank is filled with compressed air of 10.0 atm. gauge pressure, and the stirred liquid is pushed from the tank C to the tank B, and then the Alternate .Added Pressure Operation is for the first time, conducted. The Alternate Added Pressure Operation can also be conducted after stirring two times. By utilizing a sequence control or a computer memory, the most effective method may be selected.

A water supply system for ultra-multi-stored building requires many pumps and receiver tanks. Pumps and tanks are connected with may pipes, the piping of which is complicated. Accordingly, the cost and energy consumption both become great. For this reasons, a Continuous Added Pressure Operation as described above is applied to the water supply system of ultra-multi-storied buildings. Besides, according to the principle of air pressure as already described, the air pressure, which is wave motion traveling at a velocity of 340 m per second and free from gravity, can be fully utilized.

Figure 8:
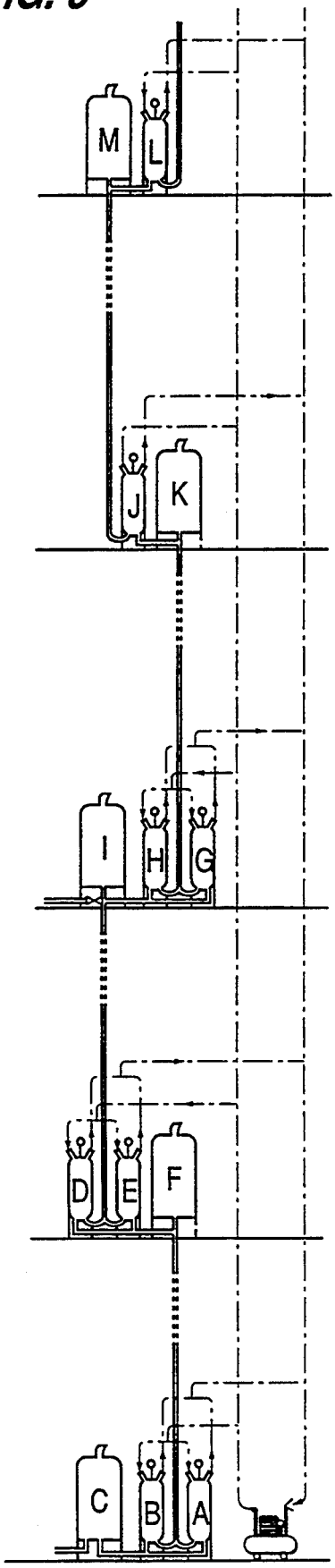
FIG. 8 illustrates a water supply system for ultra-multistoried buildings in accordance with the present invention.

FIG. 8 shows a water supply system in a building with scores of stories, in which a receiver tank is placed at every ten stories, e.g., such as 1st floor, 11th floor, 21st floor. The remaining stories between the above stories are supposed to be supplied by the natural flow of the water. The water in the receiver tank C is transferred to the receiver tank F in Alternate Added Pressure Operation between the tanks A and B. The water in the receiver tank F is transferred to the receiver tank I in Alternate Added Pressure Operation between the tanks D and E, and the water in the receiver tank I is transferred to the receiver tank K in Alternate Pressure Operation between the tanks G and H. As shown in the Figure, at floor 31 and 41, a single pressure tank is provided instead of two, which means an Alternate Added Pressure Operation over a long span is conducted. The water is introduced from the receiver tank K to the pressure tank J, and compressed air is pushed into the pressure tank J from any one of the pressure tanks Ab, De, Gh. Next, the compressed air is pushed into the receiver tank M to act on the water in the receiver tank M and transfer the water to the pressure tank L, and then the compressed air in the pressure tank J (compressed air in the other tank, may be available) is pushed into the pressure tank L for transfer to a higher place. The height of each story is 3 m, so that the height of ten stories is 30 m. Accordingly, with 4 atm. gauge pressure, which exceeds 3 atm. gauge pressure by 1 atm. gauge pressure, transfer at an ultra-multistoried building of 200 m–300 m is possible within a second. This water supply method is a milestone both in speed and energy saving.

The methods described above can be operated continuously without man's help under the control of a sequence control or computers. Explanation with respect to the present invention has been made with reference to 1 $m^3$ of water with a specific gravity of 1.0 so that the explanation may be understood well. However, the methods according to the present invention enable transferring such objects as fluid concrete, liquid including solid substances, sludge-like mud and high viscous liquids to a very distant place with high effectiveness.

Accordingly, water supply for every story of a multi-storied building and other matters which have not been carried out due to excessive cost or low effectiveness, can be conducted in accordance with the methods of the present invention.

Namely, the present invention has improved the transfer method previously provided by me and provided a transfer method that can be conducted continuously and repeatedly with high effectiveness and is available for many kinds of objects.

What is claimed is:

1. A method of transferring fluent material, comprising the steps of:

a) transferring fluent material from a first pressure tank to a fluent material transfer destination by supplying compressed gas to the first pressure tank through a compressor;

b) retaining compressed gas in the first pressure tank;

c) drawing fluent material into a second pressure tank; and d) transferring the fluent material in the second pressure tank to the fluent material transfer destination by supplying the compressed gas from the first pressure tank to the second pressure tank through the compressor;

wherein said step c) occurs at the same time as said step a), and wherein the compressor draws gas from the second pressure tank to draw the fluent material into the second pressure tank and supplies the gas to the first tank as the compressed gas.

2. A method of transferring fluent material, comprising the steps of:

a) transferring fluent material from a first pressure tank to a fluent material transfer destination by supplying compressed gas to the first pressure tank through a compressor;

b) retaining compressed gas in the first pressure tank;

c) drawing fluent material into a second pressure tank;

d) transferring the fluent material in the second pressure tank to the fluent material transfer destination by supplying the compressed gas from the first pressure tank to the second pressure tank through the compressor;

e) retaining the compressed gas in the second pressure tank; and f) drawing fluent material into the first pressure tank;

wherein said step a) occurs by the compressor supplying compressed gas from the second pressure tank to the first pressure tank; and wherein each of said steps c) and f) of drawing fluent material into the first and second pressure tanks further comprises:

i) drawing gas from a third pressure tank with a second compressor and supplying the compressed gas to a fourth pressure tank such that the pressure in the third pressure tank drops;

ii) drawing the fluent material into the third pressure tank; and iii) pushing the fluent material from the third pressure tank into one of the first and second pressure tanks with the compressed gas in the fourth pressure tank.

3. The method of claim 2, and further comprising:

g) repeating steps a)–f) at least once.

4. The method of claim 2, wherein in said step iii) of said steps c) and f), the compressed gas from the fourth pressure tank is supplied to the third pressure tank through the second compressor, the second compressor providing additional gas pressure.

5. The method of claim 2, wherein in said step iii) of said steps c) and f), the compressed gas from the fourth pressure tank is supplied to the third pressure tank directly.

6. The method of claim 2, wherein said steps a) and d) each further comprise supplying the compressed gas from one of the first and second pressure tanks to the other of the first and second pressure tanks through another pressure tank and through the compressor.

7. The method of claim 2, wherein said steps a) and d) each further comprise supplying the compressed gas from one of the first and second pressure tanks to the other of the first and second pressure tanks through another pressure tank and through the compressor.

8. The method of claim 2, wherein said step c) occurs at the same time as said step a), and said step f) occurs at the same time as said step d).

9. The method of claim 8, and further comprising:

g) repeating steps a)–f) at least once.

10. A method of transferring fluent material, comprising the steps of:

a) transferring fluent material from a first pressure tank to a fluent material transfer destination by supplying compressed gas to the first pressure tank through a compressor;

b) retaining compressed gas in the first pressure tank;

c) drawing fluent material into a second pressure tank;

d) transferring the fluent: material in the second pressure tank to the fluent material transfer destination by supplying the compressed gas from the first pressure tank to the second pressure tank through the compressor;

e) retaining the compressed gas in the second pressure tank;

f) drawing fluent material into the first pressure tank;

wherein said step a) occurs by the compressor supplying compressed gas from the second pressure tank to the first pressure tank;

g) after at least one of said steps c) and f), returning at least some of the fluent material to a fluent material supply tank from which the fluent material originated in order to stir the fluent material.

11. A method of transferring fluent material, comprising the steps of:

a) transferring fluent material from a first pressure tank to a fluent material transfer destination by supplying compressed gas to the first pressure tank through a compressor;

b) retaining compressed gas in the first pressure tank;

c) drawing fluent material into a second pressure tank;

d) transferring the fluent material in the second pressure tank to the fluent material transfer destination by supplying the compressed gas from the first pressure tank to the second pressure tank through the compressor;

e) retaining the compressed gas in the second pressure tank; and f) drawing fluent material into the first pressure tank;

wherein said step a) occurs by the compressor supplying compressed gas from the second pressure tank to the first pressure tank; and wherein:

said steps a) and d) each further comprise:

transferring compressed gas to the fluent material transfer destination along with the fluent material, the transfer destination comprising a third pressure tank containing both transferred fluent material and transferred gas; and supplying gas to the respective pressure tank having fluent material transferred therefrom from the third pressure tank through a second compressor.

12. A method of transferring fluent material, comprising the steps of:

a) transferring fluent material from a first pressure tank to a fluent material transfer destination by supplying compressed gas to the first pressure tank through a compressor;

b) retaining compressed gas in the first pressure tank;

c) drawing fluent material into a second pressure tank;

d) transferring the fluent material in the second pressure tank to the fluent material transfer destination by supplying the compressed gas from the first pressure tank to the second pressure tank through the compressor;

e) retaining the compressed gas in the second pressure tank; and f) drawing fluent material into the first pressure tank;

wherein said step a) occurs by the compressor supplying compressed gas from the second pressure tank to the first pressure tank; and wherein each of said steps c) and f) of drawing fluent material into the first and second pressure tanks further comprises:

i) drawing gas from a third pressure tank, having compressed gas therein at a relatively high pressure, and a fourth pressure tank, having gas therein at a relatively low pressure, with a second compressor and supplying the compressed gas from the second compressor to a fifth pressure tank having fluent material therein;

ii) supplying fluent material to the fourth pressure tank while the second compressor draws the gas therefrom; and iii) continuing steps i) and ii) until the third pressure tank reaches the relatively low pressure, the fourth pressure tank is filled with fluent material to a predetermined level and the fifth pressure tank is empty of fluent material and has compressed gas therein at the relatively high pressure.

13. The method of claim 12, and further comprising supplying fluent material by repeating said steps i)–iii) for one of said steps c) and f), wherein the third, fourth and fifth pressure tanks alternate roles in the repeated said steps i)–iii) in accordance with the conditions thereof after the previous said step iii).

14. A method of transferring fluent material, comprising the steps of:

a) transferring fluent material from a first pressure tank to a fluent material transfer destination by supplying compressed gas to the first pressure tank through a compressor;

b) retaining compressed gas in the first pressure tank;

c) drawing fluent material into a second pressure tank;

d) transferring the fluent material in the second pressure tank to the fluent material transfer destination by supplying the compressed gas from the first pressure tank to the second pressure tank through the compressor;

e) retaining the compressed gas in the second pressure tank f) drawing fluent material into the first pressure tank;

wherein said step a) occurs by the compressor supplying compressed gas from the second pressure tank to the first pressure tank;

g) filling a third pressure tank, having gas therein at a relatively low pressure, with fluent material transferred from the first and second pressure tanks while having a second compressor draw gas from the third pressure tank;

h) drawing gas from a fourth pressure tank, having gas therein at a relatively high pressure, with the second compressor at the same time as said step g); and i) supplying the gas drawn from the third and fourth pressure tanks with the second compressor to a fifth pressure tank having previously-transferred fluent material therein and transferring the fluent material therefrom at the same time as said steps g) and h);

wherein, after said steps g)–i), the third pressure tank is filled with a predetermined amount of fluent material, the fourth pressure tank is filled with gas at the relatively low pressure and the fifth pressure tank is filled with gas at the relatively high pressure.

15. The method of claim 14, and further comprising:

j) repeating said steps g)–i) to transfer further fluent material, with the third, fourth and fifth pressure tanks alternating roles in the repeated said steps g)–i) in accordance with the conditions thereof after the previous said steps g)–i).

* * * * *